US006076211A

United States Patent [19]

Chatman

[11] Patent Number: 6,076,211

[45] Date of Patent: Jun. 20, 2000

[54] SEAT CUSHION WITH MARKER

[76] Inventor: Dean A. Chatman, P.O. Box 725, Bellflower, Calif. 90706-0725

[21] Appl. No.: 09/070,079

[22] Filed: Apr. 30, 1998

[51] Int. Cl.[7] ..... A47C 20/02

[52] U.S. Cl. ..... 5/653; 5/648; 5/417; 5/420; 5/639

[58] Field of Search ..... 5/648, 417, 420, 5/653, 656, 639, 643, 645; 40/727; 297/452.1

[56] References Cited

U.S. PATENT DOCUMENTS

| | | | |
|---|---|---|---|
| D. 363,951 | 11/1995 | Chatman | D20/42 |
| 4,190,918 | 3/1980 | Harvell | 5/465 |
| 4,604,987 | 8/1986 | Keltner | 5/653 X |
| 4,783,120 | 11/1988 | Klechlin | 5/653 |
| 4,843,622 | 6/1989 | Handelman | 5/653 |
| 4,854,637 | 8/1989 | McCree | 5/653 |
| 4,863,003 | 9/1989 | Carter | 5/653 |
| 4,923,247 | 5/1990 | Malmstrom | 5/654 X |
| 5,253,368 | 10/1993 | Blake | 40/329 X |
| 5,421,637 | 6/1995 | Lemburg | 5/653 X |

*Primary Examiner*—Michael F. Trettel
*Assistant Examiner*—Fredrick Conley
*Attorney, Agent, or Firm*—Fulbright & Jaworski

[57] ABSTRACT

A combined seat cushion for use by fans at sporting events, includes a seat cushion having a resilient cushion member, a pliable cover enclosing the cushion member including a handle formed therein at an edge of the cushion, a sign container disposed at the edge of the cushion, a marker detachably connected to the cushion, an eraser pad for the marker retained in the pliable cover, and a panel container overlying a side of the cushion. The panel container holds a folded panel having an unfolded dimension greater than the area of the side of the seat cushion, and the sign container holds preprinted signs or blank signs on which desired messages may be imprinted with the marker, or erased with the eraser pad as desired.

13 Claims, 3 Drawing Sheets

SEAT CUSHION WITH MARKER

FIELD OF THE INVENTION

The invention relates to seat cushions for use in sports stadiums, and more particularly to a seat cushion having visual display media useful for exhibition during an event.

BACKGROUND OF THE INVENTION

It is well known that the seating arrangements in many sports arenas, particularly outdoor stadiums, are not particularly comfortable. As a result, many attendees have been known to bring pillows, blankets, or other padding material to the game.

It is also becoming increasingly common for fans to exhibit signage, colored cards to be held overhead, or other display material (either individually or in coordination with others in a group) for viewing by those on the opposing side of the stadium or by the television audience. However, carrying sufficient and varied display material into an arena and maintaining access to the material in the small area afforded by most stadium seats has been fraught with problems. For example, if a group display is desired, the persons in the group should have signage, overhead cards or other material that is the same in size, type and color. This equipment requires coordination by the group leaders that may involve significant time and planning. Also, there are problems with logistics associated with ensuring that all fans within the display group have the proper display with them at the time of planned use.

Thus, it has been a desideratum to provide a device that will provide comfortable seating along with a variety of display material as a unit that will facilitate storage, distribution to, and use by fans in a sports arena.

SUMMARY OF THE INVENTION

The invention provides a combined seat cushion adapted to include display material, including a resilient cushion member, having two sides and an edge and an essentially planar aspect on at least one of the sides; a sign container disposed at the edge of the cushion; and a panel container overlying a side of the cushion, preferably on the planar side. The panel container is adapted to receive a folded display panel or sign having an unfolded dimension greater than the area of the side of the seat cushion. In another aspect of the invention the sign container is detachably affixed to the seat cushion, and can include a set of preprinted or blank signs adapted to be disposed within the sign container, and the combined seat cushion also includes a marker detachably affixed to the cushion and adapted to mark on the blank signs or the panel. Also, the seat cushion also preferably includes an erasing member, capable of erasing markings made with the marker, withdrawably disposed within one of the containers. The cushion may further include a pliable cover enclosing the cushion member, and a handle disposed on an edge of the cushion, preferably formed as part of the pliable cover.

DETAILED DESCRIPTION OF THE INVENTION

Figure 1:
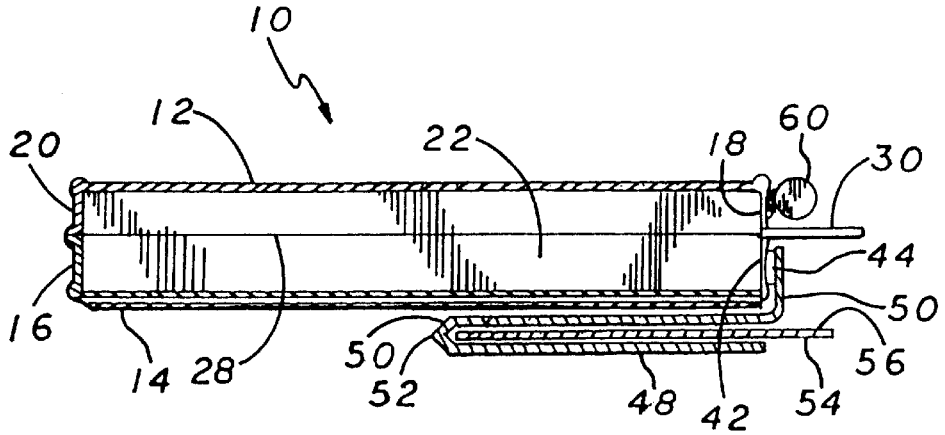
FIG. 1 is a side elevational view of the combined seat cushion, display material and marker of the invention.

The invention provides a seat cushion constructed to include display material, and includes the characteristics desired by sports fans and organizers of sports events that take place in arenas, particularly when the event is televised or otherwise visually reported by the media. As will be apparent from the following description, the cushion provides seating comfort for the fan in arenas, and also enables the attendees to have immediate access to a plurality of signage and other material that can be used for display to those in an arena or for viewing by television. In particular, organized sections in the arena, such as a block of students in a university cheering section, can all be provided with cushions, and signs of the same size and type so that consistent action across the entire section is possible. Specifically, one or more colored or printed folded panels may be provided in the panel container so that individuals may, as instructed by the section leader, unfold the panel to a size greater than the area of the side of the seat cushion and hold the panel overhead to present a coordinated design or message to the television audience or to the other side of the arena. In addition, the marker and erasing cloth may be used to generate a wide variety of messages on the unfolded panel that are significantly larger and more visible than previously possible. Most importantly, the combined seat cushion/display material unit can be distributed to attendees as they enter the seating section so that organizers can be certain that all individuals in the section have the proper signage and display material.

To this end, a combined seat cushion 10 is shown in the Figures. The cushion is seen to have an essentially planar aspect, that is, having a width greater than thickness and capable of being used as seat padding, and first and second opposite sides (shown in the orientation of FIG. 2 as top and bottom sides having a top surface 12 and a bottom surface 14) and an edge 16 therebetween. The edge 16 includes a front edge 18, a back edge 20, and two side edges 22 and 24. The seat cushion has dimensions, in this embodiment, of about 12 inches along the edges 22 and 24, and 15 inches along the edges 18 and 20.

In this embodiment, the seat cushion 10 includes a resilient cushion member, which is not shown by a reference numeral as it is enclosed within a pliable cover 26. The cushion member is made of a virgin vinyl or nylon vinyl flame retardant foam and in this embodiment has a thickness of about two inches. The cover 26 is a pliable vinyl material, but can also be made of nylon or leather. The appropriate elastomeric, resilient material for the cushion member and pliable plastic material for the cover 26, as well a methods for the formation of these articles, are well known in the art and are not part of this invention. In this instance, the pliable cover 26 is seen to enclose the cushion member by a thermal forming operation that results in a seam 28 around the edge 16. The cushion has a handle 30 disposed on an edge of the cushion, preferably formed as part of the pliable cover 26 such as by being part of the seam 28.

Figure 5:
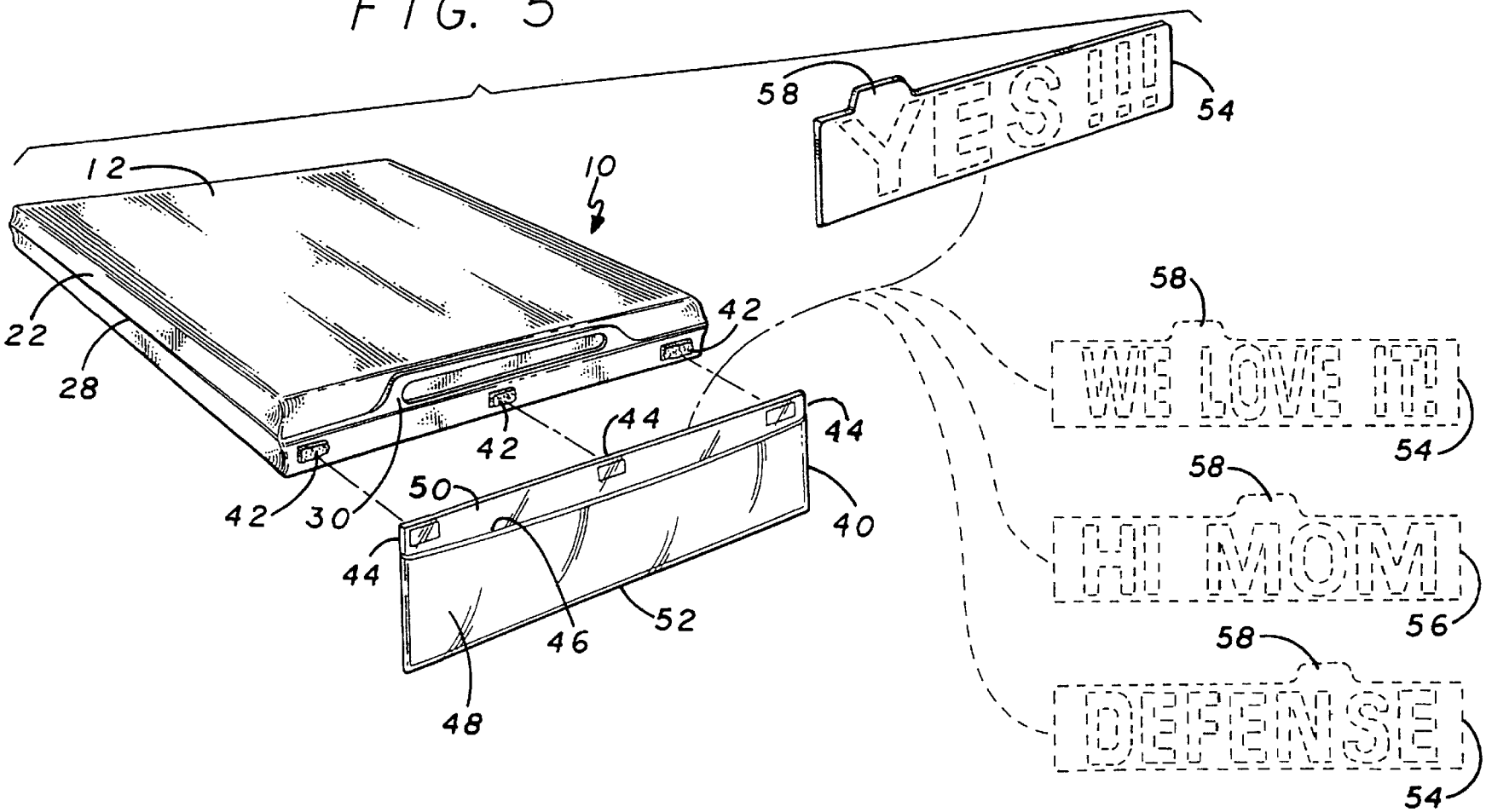
FIG. 5 is an exploded perspective view of the cushion illustrating the manner of attachment of the front pocket and manner of insertion of one or more signs therein.

As is shown in FIG. 5, the seat cushion further includes a sign container 40 disposed at the edge 18 of the cushion 10 below the handle 30, and detachably affixed to the cushion by a plurality of hook fasteners 42 on the front edge 18 of the pliable cover 26 and interlacing loop fasteners 44 on the sign container 40. The container is formed from eight mil, clear PVC polymer, and has a pocket 46 formed along the full length of the container by folding the front portion 48 over the back portion 50 along a seam 52 and thermosealing along the periphery of the pocket.

Figure 2:
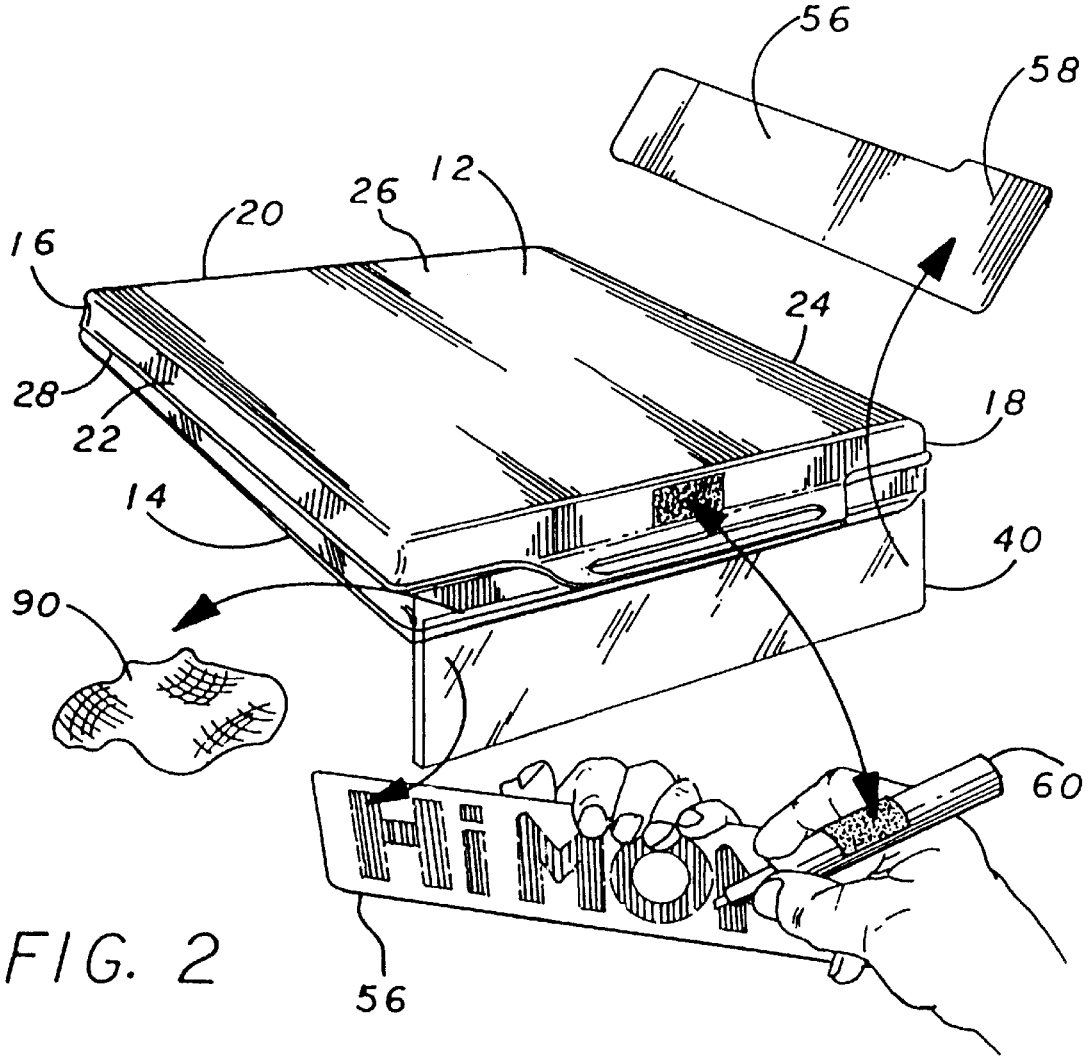
FIG. 2 is an exploded perspective view of the cushion, illustrating the use of the marker and erasing cloth.

As is shown in FIGS. 2 and 5, a plurality of signs including preprinted signs 54 and at least one blank sign 56 are sized to be removably received within the pocket 46. The signs are formed from a styrene polymer, each having (particularly for blank signs) a clear, shiny surface, and are preferably white in color. The pocket and signs are sized so that about four of the signs may be received in the pocket. During attendance at sporting contests, a variety of preprinted signs will be included in the pocket 46 and the user will, at the appropriate time, arrange the signs 54, via tabs 58, within the pocket so that the sign with the desired message is adjacent the front pocket portion 48 and visible therethrough. The cushion 10 may then be held overhead with the side edges 22 and 24 in a vertical position with the sign overlaying the bottom surface 14 and displayed at an increased height through the clear PVC front pocket portion 48 as shown in FIG. 1.

Of particular value in the embodiment shown in the drawings is the use of the blank signs 56 in combination with a marker 60, which is detachably affixed to the cushion by means of a hook fastener 62 on the marker and an interlacing loop fastener 64 on the front edge IS of the cushion, that is employed to mark on the blank sign. This arrangement permits the user to produce varied signs in a short period of time at the site of use, and then insert the sign into the pocket 46 for display as described in the preceding paragraph. The marker 60 is preferably an erasable board marker such as those sold under the trademarks Dry Erase or Magic Marker, although alternative marking devices can be employed as long as they are capable of marking on the blank signs in the manner described herein.

Figure 3:
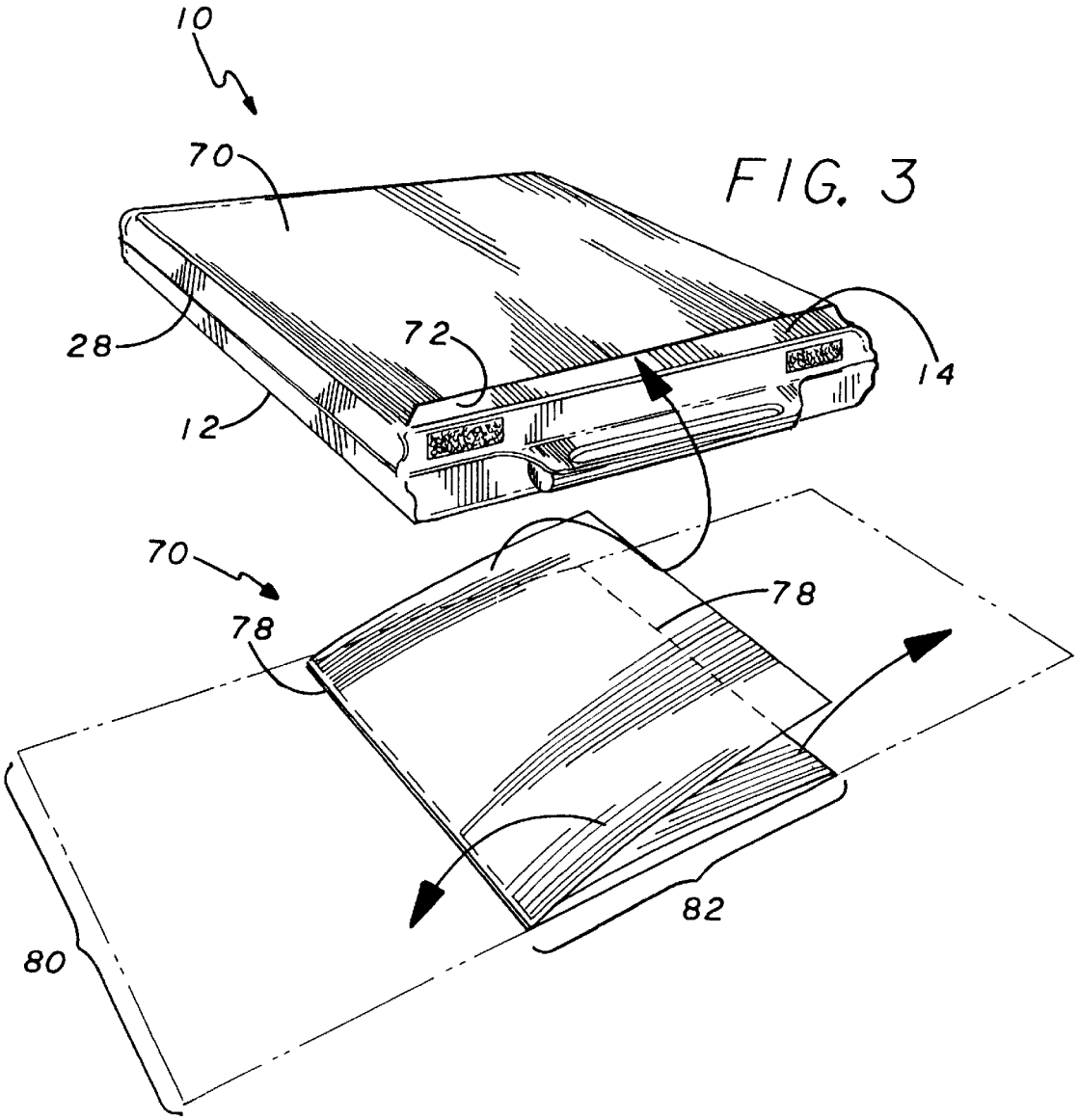
FIG. 3 is an exploded perspective view of the cushion illustrating the withdrawal of the folded panel.
Figure 4:
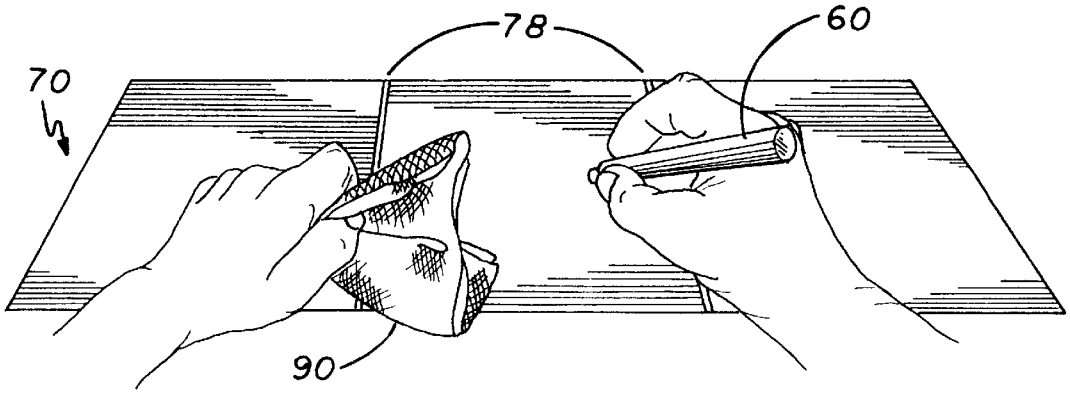
FIG. 4 is a perspective view of the unfolded panel and the use thereof in combination with the marker and erasing member.

Turning now to FIGS. 3 and 4, the cushion 10 (shown here in an inverted relationship to that of FIG. 2) is seen to include a panel container 70 overlying the bottom surface 14 of the cushion. In this embodiment, the container 70 is formed of the same pliable vinyl material as that of the cover 26, and is formed as part of the cover along the seam 28 with an open edge 72 at the cushion front edge 18. The container 70 is sized to receive a foldable display panel 76, when folded, which has an unfolded dimension greater than the area of the side of the seat cushion. The foldable panel is made of laminated styrene polymer having a clear, shiny surface to facilitate use of the marker, with hinge lines 78 scored or otherwise placed thereon so that the panel can be folded to fit within the container 70. In this embodiment, the panel 76 has a width 80 of 10 inches, and a length of 36 inches. The hinge lines 78 are placed at 12 inch intervals perpendicular to the length so that the folded panel has a length 82 of 12 inches so that the panel fits easily within the container 70.

It should be understood that the cushion 10 need only have a single planar side, the side having the panel container that receives the folded panel. For example, the cushion could have a non-planar domed, or even hemispherical, first side surface for seating comfort and still retain the planar second side surface to which the panel container is attached. In this embodiment, the first side domed surface could include the edge 16 in an area near the second side, planar surface.

With respect to advantages of the use of the blank sign/marker combination, an erasing member 90, here shown as a swatch of cloth capable of removing the markings of the erasable board marker from the blank sign 56 or the foldable panel 76, withdrawably disposed within one of the containers 40 or 70. Thus, after the marker 60 is used to inscribe a message on the blank sign or panel for use during the game, the markings can easily be erased and a new message substituted as desired.

It will also be understood that various changes and modifications to the described preferred embodiments will be apparent to those skilled in the art. Such changes and modifications can be made without departing from the spirit and scope of the invention and without diminishing the attendant advantages. It is therefore intended that such changes and modifications be covered by the appended claims.

I claim:

1. A combined seat cushion adapted to include display material, comprising:

a resilient member, having two sides, each of predetermined dimensions, and an edge, and an essentially planar aspect on at least one of the sides, a sign container disposed at the edge of the cushion; and a flexible sheet member adjacent and overlying a side of the cushion that has an essentially planar aspect forming a panel container with said cushion side a foldable display panel which, when folded, is disposed in the panel container, said foldable panel being formed of flat, rigid planer members separated by, and foldable along, hinge lines and having an unfolded dimension greater than any dimension of either side of the seat cushion.

2. The seat cushion of claim 1 in which the sign container is detachably affixed to the seat cushion.

3. The seat cushion of claim 2 which further includes a set of preprinted signs adapted to be disposed within the sign container.

4. The seat cushion of claim 1 which further includes a handle disposed on an edge of the cushion, and a blank sign adapted to be disposed within the sign container, said sign container being disposed on one side of said handle, and including a marker detachably affixed to the cushion on the opposite side of said handle and adapted to mark on the blank sign.

5. The seat cushion of claim 4 which further includes an erasing member, capable of erasing markings made with the marker, withdrawably disposed within one of the containers.

6. The seat cushion of claim 1 which further includes a pliable cover enclosing the cushion member.

7. The seat cushion of claim 4 which further includes a pliable cover enclosing the cushion member.

8. The seat cushion of claim 5 which further includes a pliable cover enclosing the cushion member.

9. The seat cushion of claim 1 which further includes a handle disposed on an edge of the cushion.

10. The seat cushion of claim 9 in which the handle is formed as part of the pliable cover.

11. The seat cushion of claim 4 in which the handle is formed as part of the pliable cover.

12. The seat cushion of claim 4 in which said chusion and marker have respective ones of hook and loop fastener members to facilitate detachable fixation of the marker to the cushion.

13. A combined seat cushion adapted to include display material, comprising:

a resilient cushion member, having two sides, each of predetermined dimensions, and an edge, and an essentially planar aspect or at least one of the sides;

a flexible sheet member overlying a side of the cushion that has an essentially planar aspect, forming a panel container with said cushion side; and a foldable display panel which, when folded, is disposed in the panel container, said foldable panel being formed of flat, rigid planar members separated by, and foldable along, hinge lines and having an unfolded dimension greater than any dimension of either side of the seat cushion.

* * * * *